United States Patent [19]

Sasaki et al.

[11] 4,426,978

[45] Jan. 24, 1984

[54] FUEL SUPPLY CONTROL SYSTEM FOR AN INTERNAL COMBUSTION ENGINE

[75] Inventors: Michiaki Sasaki, Yokohama; Kiyokazu Yamamoto; Ko Hiratsuka, both of Fujisawa, all of Japan

[73] Assignees: Nissan Motor Company, Limited; Jidosha Denki Kogyo Kabushiki Kaisha, both of Kanagawa, Japan

[21] Appl. No.: 230,287

[22] Filed: Jan. 30, 1981

[30] Foreign Application Priority Data

Jan. 31, 1980 [JP] Japan ..... 55-10576
Jan. 31, 1980 [JP] Japan ..... 55-10577

[51] Int. Cl.[3] ..... F02M 39/00
[52] U.S. Cl. ..... 123/458; 123/459; 123/463
[58] Field of Search ..... 123/458, 459, 514, 463, 123/512, 511

[56] References Cited

U.S. PATENT DOCUMENTS

| | | | |
|---|---|---|---|
| 3,699,931 | 10/1972 | Cinquegrani | 123/458 |
| 3,827,409 | 8/1974 | O'Neill | 123/458 |
| 3,911,884 | 10/1975 | Moriya et al. | 123/458 |
| 3,935,851 | 2/1976 | Wright et al. | 123/458 |
| 3,949,713 | 4/1976 | Rivere | 123/458 |
| 4,260,333 | 4/1981 | Schillinger | 123/458 |

FOREIGN PATENT DOCUMENTS

| | | | |
|---|---|---|---|
| 2808731 | 6/1979 | Fed. Rep. of Germany . | |
| 55-98652 | 7/1980 | Japan | 123/459 |

OTHER PUBLICATIONS

John Markus, Electronic Circuits Manual, 1971, p. 434.

*Primary Examiner*—Charles J. Myhre
*Assistant Examiner*—Magdalen Moy
*Attorney, Agent, or Firm*—Lowe, King, Price & Becker

[57] ABSTRACT

A sensor detects the flow rate of fuel returned from an internal combustion engine to a fuel tank to control a pump motor in such a manner that an appropriate amount of fuel is supplied from the pump to the engine.

21 Claims, 12 Drawing Figures

FUEL SUPPLY CONTROL SYSTEM FOR AN INTERNAL COMBUSTION ENGINE

BACKGROUND OF THE INVENTION

1. Field of the Invention

The present invention relates to a fuel supply control system for an internal combustion engine, and more particularly to a fuel pump control system which controls the fuel pump according to the flow rate of the fuel returned from the engine.

2. Description of the Prior Art

Recently, electrical fuel feed pumps for automotive vehicles having electrical drive motors have been used extensively. The feed pumps are classified mainly into rotary types and reciprocal types. Generally, these feed pumps supply fuel at a constant rate independently of the engine rotational speed and fuel consumption rate and return surplus fuel through a fuel return passageway to the fuel tank.

In such a fuel supply-return system, most of the fuel supplied to the engine is returned to the tank during low engine speed (idling) when only a small amount of fuel is consumed, so that the pump is operated at an unnecessarily high rate. Further, uncomfortably loud pump operating noises are transmitted to the driver and passengers in the car because the pump rotates at its full speed during low speed engine rotation when engine noise is low.

In order to solve these drawbacks, systems have been proposed which sense the engine speed, the vehicle speed, the engine intake pressure, changes in the pump discharge pressure and so forth to calculate the fuel consumption rate of the engine, thereby controlling the voltage or current of the pump drive electrical circuit. It is very difficult, however, to sense a fuel consumption rate corresponding to a vehicle running pattern. These systems require several sensors to detect the above operational parameters, and a complicated electrical circuit which processes the signals from the sensors. Thus these systems are very expensive.

SUMMARY OF THE INVENTION

A fuel supply control system for an internal combustion engine according to the present invention includes a control means which responds to the flow rate of surplus fuel returned from the engine to a fuel tank to control an electrical pump in such a manner that an appropriate amount of fuel is supplied by the pump to the engine.

BRIEF DESCRIPTION OF THE DRAWINGS

The objects, features and advantages of the present invention will be apparent from the following description of preferred and alternative embodiments thereof, taken in conjunction with the accompanying drawings in which the same reference numerals designate corresponding elements throughout the drawings and in which.

DETAILED DESCRIPTION OF THE PREFERRED AND ALTERNATIVE EMBODIMENTS

Figure 1:
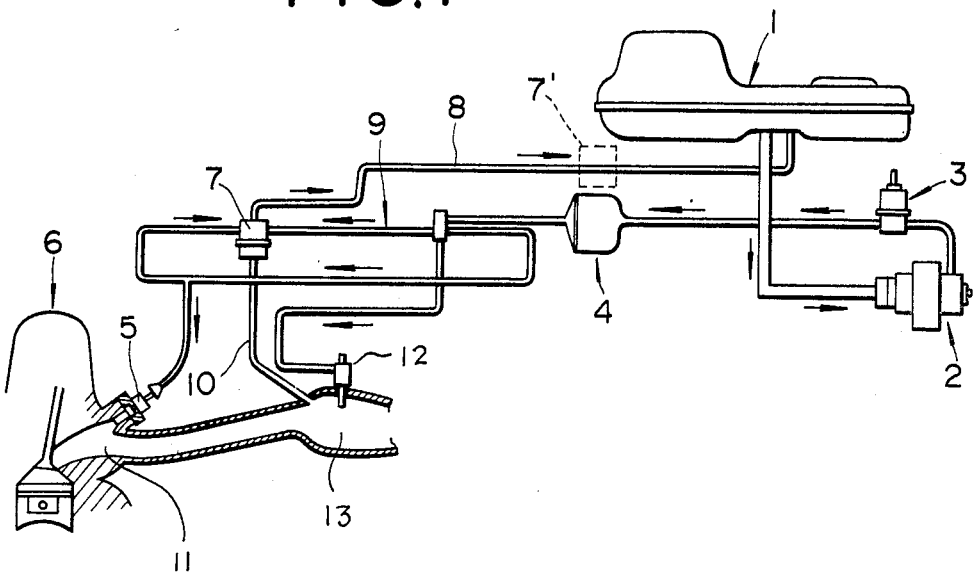
FIG. 1 is a diagramatic view of a fuel supply system to which the present invention is applied.

Referring to FIG. 1, there is shown a fuel supply system for a fuel injection type internal combustion engine to which the present invention is applied. Fuel is supplied by the operation of an electrical pump 2 from a fuel tank 1 through a damper 3 which damps pulsations in the fuel flow, and a filter 4 to an injector 5 which injects the fuel into the intake port 11 of the engine 6. Fuel not used by the injector 5 is returned through a pressure regulator 7 and a return fuel passage 8 to the fuel tank 1. The fuel pump 2 can be either of the rotational type or of the reciprocal type. A cold-start valve 12 serves to inject an additional amount of fuel into the intake manifold 13, when the engine is cold.

Figure 2:
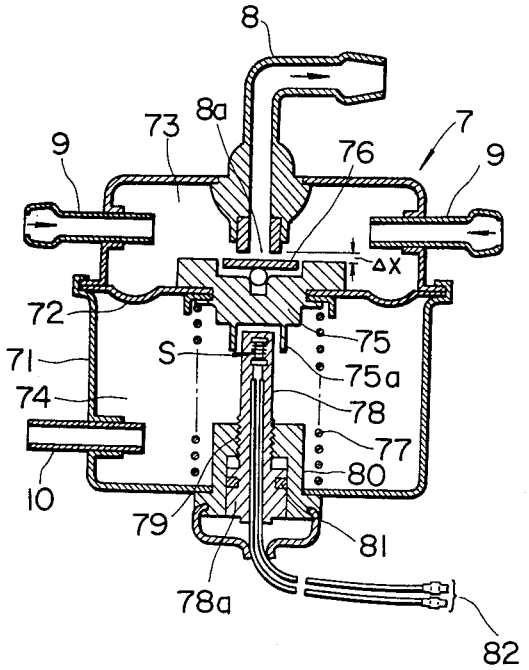
FIG. 2 is a pressure regulator used in the system of FIG. 1 and in which a sensor constituting a part of the present invention is accommodated.

Referring to FIG. 2, the regulator 7 includes a housing 71 provided with a diaphragm 72 partitioning the inside of the housing 71 into a fuel chamber 73 and a vacuum chamber 74. The fuel chamber 73 has the fuel supply passageway 9 and the return fuel passageway 8 open into it while the vacuum chamber 74 communicates through a vacuum passageway 10 with the intake vacuum of the engine 6.

The diaphragm 72 has a vertically displaced member 75 fixed thereto; to valve member 76, facing the opening 8*a* of the return fuel passageway, is in turn fixed to member 75. Thus the clearance $\Delta x$ between the valve member 76 and the open end 8*a* of the return fuel passageway 8 changes according to the vertical displacement of the diaphragm 72 to control the amount of fuel flowing into the passage 8. A spring 77, disposed between the member 75 and the bottom of the vacuum chamber 74, biases the member 75 toward the opening end of the fuel return pipe 8.

A sensor S, including a coil and constituting part of the present invention, is embedded in the top end of a hollow cylindrical fixed member 78 extending vertically from the bottom of vacuum chamber 74. A hollow cylindrical portion 75*a* of the member 75 receiving the sensor S, is moved relative to the sensor S by the vertical movement of the diaphragm 72. The member 75 and the cylindrical portion 75*a* are made of a magnetic material so that an electromotive force is induced in the sensor coil by the relative movement of the coil and the magnetic cylindrical portion 75*a*. The fixing member 78 is threadedly engaged at 79 with a cup-like support 80 fixed to the vacuum chamber 74 bottom and has an enlarged base portion 78*a* accommodated in the cup-like support 80 sealed by a seal ring 81 in an airtight manner.

Figure 3:
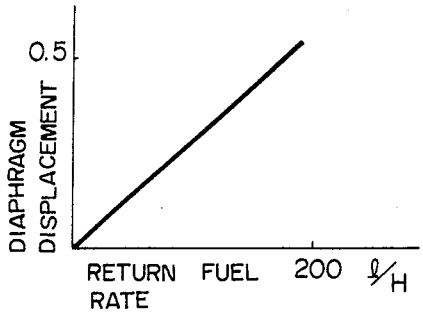
FIG. 3 is a graphical representation of diaphragm displacement versus return fuel flow rate.

When the amount of fuel injected into the engine decreases compared with the amount of fuel discharged from the pump 2, the pressure of fuel within the fuel chamber 73 increases and pushes down the diaphragm 72 so that the clearance Δx and therefore the return fuel flow rate increases. As is well known, the regulator 7 performs a control operation such that the difference between the fuel pressure and the intake vacuum pressure in the intake port 11 is constant, thereby facilitating control of the amount of fuel injected. More particularly, since the amount of fuel injected by the injector 5 is affected by the time during which the injector is open as well as by the difference between the fuel pressure and the intake vacuum pressure in the intake port, the pressure regulator 7 operates in such a way that the amount of fuel injected is a function only of the time during which the injector 5 is open; the differential pressure does not affect the amount of fuel injected. The displacement or the clearance Δx of the diaphragm 72 is proportional to the return fuel rate as shown in FIG. 3.

Figure 4:
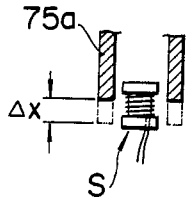
FIG. 4 is an illustration of the operation of the sensor.
Figure 5:
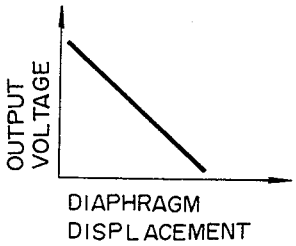
FIG. 5 is a graphical representation of sensor output versus diaphragm displacement.

The position sensor S electromagnetically detects the displacement of the diaphragm 72, as shown in FIG. 4, to produce a signal representing the displacement. In this embodiment, the sensor S is adapted to produce a linearly decreasing output voltage as the diaphragm displacement Δx increases, as shown in FIG. 5.

Figure 6:
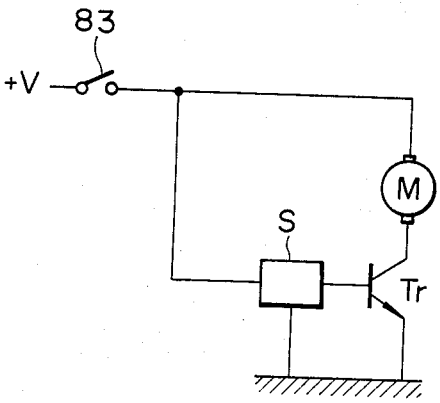
FIG. 6 is a schematic diagram of a preferred embodiment of a fuel supply control system according to the present invention.

The output of the sensor S is applied through a pair of leads 82 (FIG. 2) to the base of a transistor Tr provided in a fuel supply control circuit according to the present invention, as shown in FIG. 6. A biasing voltage is applied through a switch 83 from the power supply +V to the transistor base. The emitter of the transistor Tr is grounded and the collector thereof is connected through an electrical motor M for pump 2 and the switch 83 to the power supply. Thus the fuel supply control circuit serves to control the rotational speeds of the motor M so that the speeds of the motor and pump 2 are inversely proportional solely to the flow rate of the return fuel, as shown in FIG. 5.

An instantaneous fuel consumption rate could be displayed with relatively high accuracy by providing the system of the present invention with means for sensing the discharge of the fuel pump. The sensor S is shown as being of the type which produces an analog output, but may be of the type which produces a digital output such as a reed relay.

Figure 7:
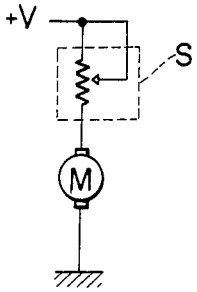
FIG. 7 is a view, similar to FIG. 6, of a second embodiment of the present invention.
Figure 8:
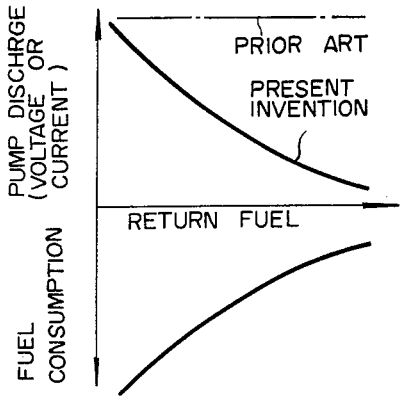
FIG. 8 is a graphical representation of return fuel flow rate versus pump discharge of the system illustrated in FIG. 7.

Referring to FIG. 7, where is shown a second embodiment of a fuel supply control system according to the present invention. The sensor S is a variable resistor having a resistance which changes according to the change in the flow rate of the fuel. The variable resistor is connected in series with the fuel feed pump motor M across the power supply +V so that the speed of the fuel feed pump motor M is controlled by a change in the flow rate. The value of the resistor increases as the flow rate of return fuel from the engine increases, whereby the driving voltage or current applied to the motor M, and hence the pump M discharge, decreases as the flow rate of the return fuel increases, and hence as the engine fuel consumption decreases, as shown in FIG. 8.

Figure 9:
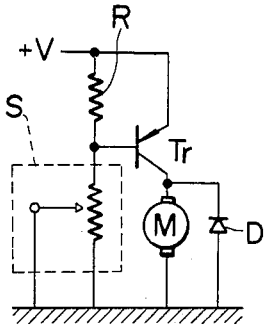
FIG. 9 is a view, similar to FIG. 6, of a third embodiment of the present invention.

In FIG. 9, a third embodiment of the present invention, is shown in which a transistor Tr is provided in the driving circuit of the fuel feed pump motor M so that, as the flow rate of the return fuel changes, the base voltage of the transistor changes to control the operation of the motor M. The system includes a sensor S which has characteristics similar to those of the sensor in FIG. 8. The sensor is connected between the base of the transistor Tr and ground. The base of the transistor is connected through a biasing resistor Ro to the power supply +V, and the emitter of the transistor Tr is connected directly to the power supply +V. The motor M is connected in parallel with a protective diode D between the collector of the transistor Tr and ground. The operational characteristics of the system in FIG. 9 are similar to those of FIG. 8.

Figure 12:
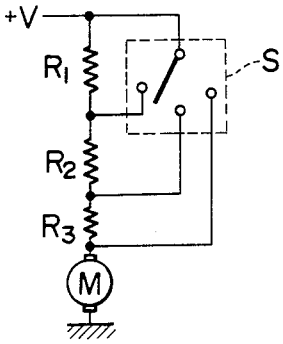
FIG. 12 is a view, similar to FIG. 6, of a fifth embodiment of the present invention.
Figure 10:
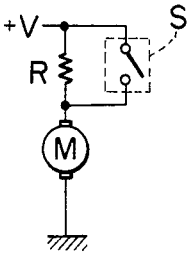
FIG. 10 is a view, similar to FIG. 6, of a fourth embodiment of the present invention.
Figure 11:
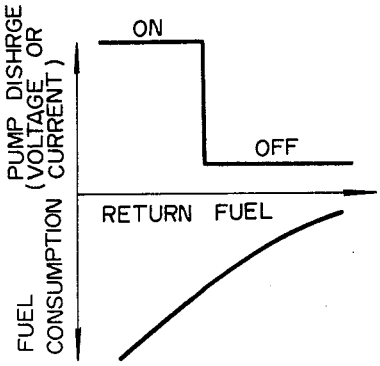
FIG. 11 is a graphical representation, similar to FIG. 8, of the operation of the embodiment of FIG. 10.

FIGS. 10 and 12 are illustrations of fourth and fifth embodiments of the present invention which use a sensor S which switches off when the flow rate of the return fuel exceeds a predetermined value, so that the fuel pump is stepwise controlled. The system illustrated in FIG. 10 includes a resistor R and a sensor-switch S connected in parallel with the resistor R provided in the driving and control circuit of the motor M. In this embodiment, the switch S operates such that it is opened to reduce the voltage applied to the motor M when the flow rate of the return fuel is greater than a predetermined value i.e., when the engine fuel consumption rate is below a predetermined value. Switch S is closed to restore the voltage applied to the motor M when the flow rate of the return fuel is less than the predetermined value, i.e., when the engine fuel consumption rate exceeds the predetermined rate, as shown in FIG. 11.

The embodiment of FIG. 12 includes plural, for example three, resistors $R_1$, $R_2$, $R_3$ connected in series with each other and with the motor M and a switch S stepwise positioned to engage taps connected to the resistors according to the flow rate of the return fuel to control the pump operation stepwise.

In summary, as is clear from the above description, the fuel supply control system according to the present invention senses the return fuel rate to produce a representative signal which controls the voltage or current supplied to the fuel feed pump, thereby controlling the operation of the fuel feed pump simply and accurately so as to reduce unnecessary operation of the pump. This improves the durability of the pump, greatly decreases the noise within the passenger compartment while the the pump is operating at low fuel consumption (idling), and prevents an increase in the temperature and deterioration of the fuel within the fuel tank. This system also simplifies the sensing of the engine fuel consumption rate, and improves the flow rate of fuel supplied to the engine, at low cost. The fuel supply control system of the present invention may be used as a fuel consumption meter.

Although the present invention has been shown and described in terms of several preferred embodiments thereof, the exact details of any particular embodiment are subject to various modifications, changes and/or omissions, by a person of ordinary skill in the art, depending upon the foregoing disclosure, without departing from the scope or the spirit of the present invention. Therefore it is desired that the aforesaid scope, as well as the breadth of the protection granted, should be defined, not by any of the details of the shown embodiments, or of the drawings, but solely by the appended claims, which follow.

What is claimed is:

1. A fuel supply control system for an internal combustion engine of the type wherein excess fuel supplied to the engine is returned from the engine to a fuel supply source for the engine, comprising:

(a) a pump for circulating fuel between the fuel supply source and said engine; and (b) control means responsive to the rate of flow of the fuel from the engine to said fuel supply source for controlling said pump in such a manner that a minimal amount of fuel beyond that required by said engine is supplied by said pump to said engine, said control means including a transistor and a sensor for sensing the rate of flow of the fuel from said engine to produce a signal representing the rate of flow of the fuel returned, said signal being coupled to a control electrode of said transistor, said pump including a motor connected in the emitter collector path of said transistor, the magnitude of said signal decreasing as the rate of flow of fuel increases, thereby decreasing the torque for said motor.

2. A fuel supply control system for an internal combustion engine of the type wherein excess fuel supplied to the engine is returned from the engine to a fuel supply source for the engine, comprising:

(a) a pump for circulating fuel between the fuel supply source and said engine; and (b) control means responsive to the rate of flow of the fuel from the engine to said fuel supply source for controlling said pump in such a manner that a minimal amount of fuel beyond that required by said engine is supplied by said pump to said engine, said pump including a motor for driving said pump, control means including a sensor for sensing the rate of flow of the fuel returned from said engine, said sensor including a resistor having a variable resistance value which changes according to the rate of flow of fuel to control the driving circuit or voltage of the motor of said pump.

3. A fuel supply control system for an internal combustion engine of the type wherein excess fuel supplied to the engine is returned from the engine to a fuel supply source for the engine, comprising:

(a) a pump for circulating fuel between the fuel supply source and said engine; and (b) control means responsive to the rate of flow of the fuel from the engine to said fuel supply source for controlling said pump in such a manner that a minimal amount of fuel beyond that required by said engine is supplied by said pump to said engine, said control means including a resistor connected in series with a motor for driving the pump and a switch for short-circuiting said resistor in response to the rate of flow of fuel from said engine exceeding a predetermined value to decrease the rate of flow of the fuel supplied by said pump to said engine.

4. A fuel supply control system for an internal combustion engine of the type wherein excess fuel supplied to the engine is returned from the engine to a fuel supply source for the engine, comprising:

(a) a pump for circulating fuel between the fuel supply source and said engine; and (b) control means responsive to the rate of flow of the fuel from the engine to said fuel supply source for controlling said pump in such a manner that a minimal amount of fuel beyond that required by said engine is supplied by said pump to said engine, a motor for driving said pump, said control means including a plurality of resistors connected in series with each other and with said motor, and a switch for stepwise switching said plurality of resistors such that a resistor having a stepwise-varying resistance is connected in series with said motor, said switch switching said plurality of resistors stepwise so as to increase the resistance of said plurality of resistors as the rate of flow of fuel from said engine to said fuel tank increases.

5. A fuel supply control system for an internal combustion engine of the type wherein excess fuel supplied to the engine is returned from the engine to a fuel supply source for the engine, comprising:

(a) a pump for circulating fuel between the fuel supply source and said engine; and (b) control means responsive to the rate of flow of the fuel from the engine to said fuel supply source for controlling said pump in such a manner that a minimal amount of fuel beyond that required by said engine is supplied by said pump to said engine, said control means comprising:

(a) a pressure regulator means including a housing, a diaphragm partitioning the inside of said housing into two chambers, one of said chambers including an inlet for receiving fuel returned from said engine and an outlet communicating with said tank, said other chamber communicating with an air intake passage to the engine;

(b) a valve member attached to said diaphragm and biased by said diaphragm toward said outlet, said valve member being moved away from said outlet against the biased valve member in response to the fuel pressure within said one chamber increasing;

(c) means for sensing the displacement of said valve member from said outlet, said sensing means being adapted to produce a signal having a magnitude which decreases as the displacement increases; and (d) means responsive to the signal for decreasing the drive torque for said pump as the signal decreases, thereby decreasing the rate of flow of fuel fed from said pump to the engine.

6. A fuel supply control system for an internal combustion engine of the type wherein excess fuel supplied to the engine is returned from the engine to a fuel supply source for the engine, comprising:

(a) a pump for circulating fuel between the fuel supply source and said engine; and (b) control means responsive to the rate of flow of the fuel from the engine to said fuel supply source for controlling said pump in such a manner that a minimal amount of fuel beyond that required by said engine is supplied by said pump to said engine, said control means including sensing means for sensing the rate of fuel flow from the engine to said fuel supply source, said sensing means including a resistor having a value which increases as the rate of flow of fuel increases, said resistor being connected to an electric motor for driving said pump, thereby decreasing the driving current for said motor when the resistance of said resistor increases.

7. A fuel supply control system for an internal combustion engine of the type wherein excess fuel supplied to the engine is returned from the engine to a fuel supply source for the engine, comprising:

(a) a pump for propelling fuel from the fuel supply source to said engine; and (b) control means responsive solely to the rate of flow of fuel from the engine to said fuel supply source for controlling said pump in such a manner that a minimal amount of fuel beyond that required by said engine is supplied by said pump to said engine.

8. A fuel supply control system for an internal combustion engine of the type wherein excess fuel supplied to the engine is returned from the engine to a fuel supply source for the engine comprising means for sensing the fuel returned from the engine to the supply, and means responsive solely to the sensed returned fuel for controlling the flow rate of fuel supplied by the source to the engine.

9. A method of supplying fuel to an internal combustion engine of the type wherein excess fuel supplied to the engine is returned from the engine to a fuel supply source for the engine comprising controlling the rate of fuel supplied by the source to the engine solely in response to the fuel returned by the engine to the source.

10. A system according to claim 1, further including a pressure regulator including a diaphragm, a sensor on the pressure regulator for sensing displacement of the diaphragm in response to the pressure of the fuel returned from said engine.

11. A system according to claim 2, wherein the resistive value of the resistor increases as the flow rate of the returned fuel increases to decrease the driving current or voltage of said motor.

12. A system according to claim 2 or 11, wherein said resistor is provided in series with said motor.

13. A system according to claim 2 or 11, wherein said control means further includes a transistor, said resistor being connected between a control electrode of said transistor and ground, and said pump motor being connected in the emitter collector of said transistor.

14. A system according to claim 5, wherein said sensing means includes a magnetic member mounted on a surface of said diaphragm opposed to said valve member and moveable with said diaphragm, and a coil member fixedly secured within said other chamber and adapted to be electromagnetically coupled to said magnetic member to produce the signal.

15. A system according to claim 14, wherein said magnetic member takes the form of a hollow cylinder which can be received over said coil member.

16. A system according to claim 6, wherein said resistor increases continuously as the rate of fuel increases.

17. A system according to claim 6, wherein said resistor increases stepwise as the rate of flow of fuel increases.

18. The system of claim 8 wherein the means for controlling includes means for sensing only the flow rate of the returned fuel.

19. The system of claim 8 wherein the means for controlling includes means for increasing and decreasing the flow rate of fuel supplied by the source to the engine in response to decreases and increases of the flow rate of the returned fuel, respectively.

20. The method of claim 9 wherein the rate of fuel supplied by the source to the engine is responsive only to the rate at which fuel is returned by the engine to the source.

21. The method of claim 9 wherein the rate of fuel supplied by the source to the engine is responsive only to the rate at which fuel is returned by the engine to the source so that as the rate at which fuel is returned to the source increases and decreases the flow rate of fuel from the source to the engine decreases and increases, respectively.

* * * * *